US006055826A

United States Patent [19]

Hiraoka et al.

[11] Patent Number: 6,055,826

[45] Date of Patent: May 2, 2000

[54] REFRIGERATOR

[75] Inventors: Toshie Hiraoka; Isao Naito; Noriyuki Suda; Mutsumi Kato; Hisashi Matsui; Hiroshige Konishi; Katsumasa Sakamoto, all of Tokyo, Japan

[73] Assignee: Mitsubishi Denki Kabushiki Kaisha, Tokyo, Japan

[21] Appl. No.: 09/158,773

[22] Filed: Sep. 23, 1998

[30] Foreign Application Priority Data

Nov. 7, 1997 [JP] Japan ..... 9-305089
Mar. 17, 1998 [JP] Japan ..... 10-066429

[51] Int. Cl.[7] ..... F25D 17/04

[52] U.S. Cl. ..... 62/408; 62/441

[58] Field of Search ..... 62/407, 408, 441

[56] References Cited

U.S. PATENT DOCUMENTS

| | | | |
|---|---|---|---|
| 2,975,615 | 3/1961 | Atchison . | |
| 2,978,973 | 4/1961 | Sweedyk et al. . | |
| 3,576,114 | 4/1971 | Sharp et al. . | |
| 3,741,290 | 6/1973 | Nenadal . | |
| 4,304,175 | 12/1981 | Lang et al. . | |
| 4,607,499 | 8/1986 | Bolton et al. . | |
| 4,800,734 | 1/1989 | Sauber et al. . | |
| 5,156,015 | 10/1992 | Chung | 62/187 |
| 5,326,578 | 7/1994 | Yun . | |
| 5,392,615 | 2/1995 | Lim | 62/414 |
| 5,437,164 | 8/1995 | Consiglio . | |
| 5,461,879 | 10/1995 | Bolton et al. . | |
| 5,546,759 | 8/1996 | Lee | 62/441 |
| 5,551,252 | 9/1996 | Lee | 62/441 |
| 5,632,160 | 5/1997 | Harangozo et al. | 62/408 |
| 5,642,628 | 7/1997 | Whipple, III et al. | 62/186 |
| 5,711,159 | 1/1998 | Whipple, III | 62/82 |
| 5,737,939 | 4/1998 | Valence et al. | 62/441 |
| 5,758,512 | 6/1998 | Peterson et al. | 62/407 |
| 5,899,083 | 5/1999 | Peterson et al. | 62/186 |

FOREIGN PATENT DOCUMENTS

| | | | |
|---|---|---|---|
| 4-103984 | 4/1992 | Japan . | |
| 3-272998 | 5/1993 | Japan | 62/441 |
| 3-328514 | 6/1993 | Japan | 62/441 |
| 8-247638 | 9/1996 | Japan . | |
| 8-338681 | 12/1996 | Japan . | |

*Primary Examiner*—Henry Bennett
*Assistant Examiner*—Melvin Jones
*Attorney, Agent, or Firm*—Oblon, Spivak, McClelland, Maier & Neustadt, P.C.

[57] ABSTRACT

A refrigerator having a main body; a refrigerating compartment arranged at an upper position in the main body to refrigerate foods; and at least three lower compartments vertically arranged under the refrigerating compartment; wherein at least one of the lower compartments is a freezer compartment for freezing foods, and one of the remaining lower compartments is a vegetable compartment to store vegetables or a switchable compartment to make a temperature zone therein switchable between a freezing temperature zone and a temperature zone for refrigerated foods, vegetables or chilled foods.

17 Claims, 12 Drawing Sheets

REFRIGERATOR

BACKGROUND OF INVENTION

1. Field of the Invention

The present invention relates to a refrigerator which has a refrigerating compartment arranged at an upper position in a main body thereof, freezer compartments arranged under the refrigerating compartment and at the lowest position in the main body, and a vegetable compartment arranged between the freezer compartments.

2. Background of the Invention

Conventional refrigerators have a main body formed by an outer casing and an inner casing with a heat insulating material formed and filled therebetween, and have the inside of the main body divided into a plurality of temperature zones to provide a plurality of storage compartments having a temperature suited to each food.

Although refrigerators which have a freezer compartment at an upper position therein, a refrigerating compartment at a central position therein and a vegetable compartment at a lower position therein have been dominant, refrigerators with a variety of layout have been recently proposed.

For example, a conventional refrigerator as shown in FIG. 16 is a refrigerator called a mid freezer wherein freezer compartments 200, 250 are arranged at a central position therein. The refrigerator has such a specific structure that a refrigerating compartment 100 with a door is arranged at the highest position in the refrigerator 1, the freezer compartments 200, 250 with drawers are arranged at a central position in the refrigerator so as to be put one on the other, and a vegetable compartment 300 with a drawer is arranged at the lowest position in the refrigerator.

Although the refrigerating compartment 100 has easier access, the vegetable compartment 300 has a difficult access since the provision of the vegetable compartment 300 under the freezer compartments 200, 250 with a small frequency of use forces a user to have access to the vegetable compartment 300 in a squatting position. Considering that vegetables have the freshness thereof immediately deteriorated, the provision of the vegetable compartment 300 under the freezer compartments 200, 250 for a long term of storage of frozen foods does not match the actual state of use because the vegetable compartment requires a constant check for freshness.

On the other hand, a conventional refrigerator as shown in FIG. 17 is a refrigerator called a mid-vegetable compartment with a vegetable compartment 300 arranged at a central position therein. The refrigerator has such a specific structure that a freezer compartment 250 with a drawer is arranged at the lowest position therein, a freezer compartment 200 with an ice storing compartment 202 provided therein is arranged above the freezer compartment, and the vegetable compartment 300 is arranged above the freezer compartment 200 and at a central position therein.

Although the vegetable compartment 300 has easier access, the ice storing compartment 202 has a difficult access since the provision of the ice storing compartment 202 with a great frequency of use particularly in summer under the vegetable compartment 300 forces a user to have access to the ice storing compartment in a crouching position.

In addition, the provision of the ice storing compartment under the vegetable compartment 300 creates a problem in terms of hygiene because the ice in the ice storing compartment is used without treatment prior to use and because contamination on vegetable in the vegetable compartment could adhere on the ice in the ice storing compartment.

Since conventional refrigerators have been constructed as stated earlier, the conventional refrigerator show in FIG. 16 provides easier access to the refrigerating compartment 100 though it has created the a problem in that the vegetable compartment 300 is difficult of access since the provision of the vegetable compartment 300 under the freezer compartments 200, 250 with a small frequency of use forces a user to have access to the vegetable compartment 300 in a squatting position.

The conventional refrigerator shown in FIG. 17 provides easier access to the vegetable compartment 300 though it has created the problem that the ice storing compartment 202 is difficult of access since the provision of the ice storing compartment 202 with a great frequency of use particularly in summer under the vegetable compartment 300 forces a user to have access to the ice storing compartment in a crouching position.

In addition, the provision of the ice storing compartment under the vegetable compartment 300 has created problem in terms of hygiene because the ice in the ice storing compartment is used without treatment prior to use and because contamination on the vegetables could adhere on the ice.

SUMMARY OF THE INVENTION

It is an object of the present invention to solve these problems, and to provide a refrigerator with a freezer compartment wherein each of a refrigerating compartment, a vegetable compartment and a freezer compartment is arranged at a position with easy access to improve accessibility to each of the compartment.

It is another object of the present invention to provide a refrigerator with a freezer compartment which attaches importance to accessibility to a vegetable compartment as usual, and wherein an ice storing compartment is prevented from being arranged at a lower position with difficult access to the ice storing compartment so as to have easy access like the vegetable compartment, and attention is given to hygiene.

It is another object of the present invention to provide a refrigerator with a freezer compartment which can cope with a change in volume in respective required temperature zones caused by a difference in dietary habits of a user or a seasonal change in the kinds of preserve foods.

It is a further object of the present invention to provide a refrigerator with a freezer compartment wherein an ice storing compartment, a switchable compartment, a vegetable compartment and a refrigerating compartment are basically arranged at positions with easy access and the layout of the respective compartments can give easy access to the respective compartments for any type of user.

The present invention provides a refrigerator which comprises a main body; a refrigerating compartment arranged at an upper position in the main body to refrigerate foods; a first freezer compartment arranged under the refrigerating compartment in the main body to freeze foods; a second freezer compartment at a lower position in the main body to freeze foods; and a vegetable compartment arranged between the first freezer compartment and the second freezer compartment in the main body to store vegetables.

The first freezer compartment may include an ice storing compartment to store ice.

The present invention also provides a refrigerator which comprises a main body; a refrigerating compartment arranged at an upper position in the main body to refrigerate foods; a first switchable compartment arranged under the refrigerating compartment in the main body to make a temperature zone therein switchable between a freezing temperature zone and a temperature zone for refrigerated foods, vegetables or chilled foods; a freezer compartment arranged at a lower position in the main body to freeze foods; and a second switchable compartment arranged between the first switchable compartment and the freezer compartment in the main body to make a temperature zone therein switchable between a freezing temperature zone and a temperature zone for refrigerated foods, vegetables or chilled foods;

The present invention also provides a refrigerator which comprises a main body; a refrigerating compartment arranged at an upper position in the main body to refrigerate foods; a switchable compartment arranged under the refrigerating compartment in the main body to make a temperature zone therein switchable between a freezing temperature zone and a temperature zone for refrigerated foods, vegetables or chilled foods; a ice storing compartment arranged in parallel with the switchable compartment under the refrigerating compartment in the main body to store ice; a freezer compartment arranged at a lower position in the main body to freeze foods; and a vegetable compartment arranged between the switchable compartment and the ice storing compartment in parallel and the freezer compartment to store vegetables.

The refrigerator may further comprise a cooling section including a cooling device for producing cooled air and a fan for supplying the cooled air into the respective compartments, and communicating with the freezer compartment; an air supply path for the freezer compartment to supply the cooled air into the freezer compartment; an air supply path for the ice storing compartment to supply the cooled air into the ice storing compartment; an air return path for the ice storing compartment to return the cooled air from the ice storing compartment into the cooling section; an air supply path for the switchable compartment to divide part of the cooled air passing through the air supply path for the ice storing compartment and supply the part into the switchable compartment; an air return path for the switchable compartment to return the cooled air from the switchable compartment into the cooling section; an air supply path for the refrigerating compartment to divide part of the cooled air passing through the air supply path for the switchable compartment and supply the part into the refrigerating compartment; an air return path for the refrigerating compartment to forward the cooled air from the refrigerating compartment into the vegetable compartment; and an air return path for the vegetable compartment to return the cooled air from the vegetable compartment to the cooling device.

The refrigerator may also further comprise a cooling section including a cooling device for producing cooled air and a fan for supplying the cooled air into the respective compartments, and communicating with the freezer compartment; an air supply path for the freezer compartment to supply the cooled air into the freezer compartment; an air supply path for the ice storing compartment to supply the cooled air into the ice storing compartment; an air return path for the ice storing compartment to return the cooled air from the ice storing compartment into the cooling section; an air supply path for the switchable compartment to supply the cooled air into the switchable compartment; an air return path for the switchable compartment to return the cooled air from the switchable compartment into the cooling section; an air supply path for the refrigerating compartment to divide part of the cooled air passing through the air supply path for the switchable compartment and supply the part into the refrigerating compartment; an air return path for the refrigerating compartment to forward the cooled air from the refrigerating compartment into the vegetable compartment; and an air return path for the vegetable compartment to return the cooled air from the vegetable compartment to the cooling device.

The refrigerator may further comprise a cooling section including a cooling device for producing cooled air and a fan for supplying the cooled air into the respective compartments, and communicating with the freezer compartment; an air supply path for the freezer compartment to supply the cooled air into the freezer compartment; an air supply path for the ice storing compartment to supply the cooled air into the ice storing compartment; an air return path for the ice storing compartment to return the cooled air from the ice storing compartment into the cooling section; an air supply path for the switchable compartment to supply the cooled air into the switchable compartment; an air return path for the switchable compartment to return the cooled air from the switchable compartment into the cooling section; an air supply path for the refrigerating compartment to divide part of the cooled air passing through the air supply path for the ice storing compartment and supply the part into the refrigerating compartment; an air return path for the refrigerating compartment to forward the cooled air from the refrigerating compartment into the vegetable compartment; and an air return path for the vegetable compartment to return the cooled air from the vegetable compartment to the cooling device.

The refrigerator may also comprise a cooling section including a cooling device for producing cooled air and a fan for supplying the cooled air into the respective compartments, and communicating with the freezer compartment; an air supply path for the freezer compartment to supply the cooled air into the freezer compartment; an air supply path for the ice storing compartment to supply the cooled air into the ice storing compartment; an air return path for the ice storing compartment to return the cooled air from the ice storing compartment into the cooling section; an air supply path for the switchable compartment to supply the cooled air into the switchable compartment; an air return path for the switchable compartment to return the cooled air from the switchable compartment into the cooling section; an air supply path for the refrigerating compartment to supply the cooled air into the refrigerating compartment; an air return path for the refrigerating compartment to forward the cooled air from the refrigerating compartment into the vegetable compartment; and an air return path for the vegetable compartment to return the cooled air from the vegetable compartment to the cooling device.

The switchable compartment may have a rear wall provided with a twin damper for carrying out temperature controls in the switchable compartment and the refrigerating compartment.

The refrigerator may further comprise a second air return path for the refrigerating compartment, which forwards part of the cooled air in the air return path for the refrigerating compartment directly to the air return path for the vegetable compartment.

The refrigerator may further comprise a first partition for dividing an inner space in the main body into an upper portion and a lower portion so as to arrange the refrigerating compartment in the upper portion, the first partition being mounted in an inner casing forming an inner side of the main body when the inner casing is shaped; a second partition arranged at a rear side in the lower portion partitioned by the first partition in the main body from a front side of the main body after a cooling section with a cooling device and an air circulating fan is mounted in the main body, the second partition separating the cooling section from the compartments and having a molded heat insulating material included therein; a third partition for dividing a portion in front of the second partition into an upper section and a lower section so as to provide the freezer compartment in the lower section; and a fourth partition having a reversed T-character cross-section for dividing a space between the first partition and the third partition into three sections so as to arrange the ice storing compartment and the switchable compartment in parallel under the first partition and arrange the vegetable compartment above the third partition.

The second partition may have air supply paths for supplying the cooled air from the cooling section into the respective compartments and air return paths for returning the cooled air from the respective compartments into the cooling section provided therein.

The refrigerator may further comprise a cooling section including a cooling device for producing cooled air and a fan for supplying the cooled air into the respective compartments, and communicating with the freezer compartment; an air supply path for the freezer compartment to supply the cooled air into the freezer compartment; an air supply path for the ice storing compartment to supply the cooled air into the ice storing compartment; an air return path for the ice storing compartment to return the cooled air from the ice storing compartment into the cooling section; an air supply path for the switchable storing compartment to supply the cooled air into the switchable compartment; an air return path for the switchable compartment to return the cooled air from the switchable compartment into the cooling section; an air supply path for the refrigerating compartment to supply the cooled air into the refrigerating compartment; an air return path for the refrigerating compartment to return the cooled air from the refrigerating compartment into the cooling section; an air supply path for the vegetable compartment to supply the cooled air into the vegetable compartment; and an air return path for the vegetable compartment to return the cooled air from the vegetable compartment to the cooling device.

When the refrigerator according to the present invention comprises a main body; a refrigerating compartment arranged at an upper position in the main body to refrigerate foods; a first freezer compartment arranged under the refrigerating compartment in the main body to freeze foods; a second freezer compartment at a lower position in the main body to freeze foods; and a vegetable compartment arranged between the first freezer compartment and the second freezer compartment in the main body to store vegetables, the refrigerator is provided which ensures easy access to the freezer compartment and which has the vegetable compartment with a great frequency of use arranged at a position with easy access for a user.

When the first freezer compartment includes an ice storing compartment to store ice, the refrigerator can be provided which has the ice storing compartment arranged at a position with easy access and good hygiene and the vegetable compartment arranged at a position with easy access.

When the refrigerator comprises a main body; a refrigerating compartment arranged at an upper position in the main body to refrigerate foods; a first switchable compartment arranged under the refrigerating compartment in the main body to make a temperature zone therein switchable between a freezing temperature zone and a temperature zone for refrigerated foods, vegetables or chilled foods; a freezer compartment arranged at a lower position in the main body to freeze foods; and a second switchable compartment arranged between the first switchable compartment and the freezer compartment in the main body to make a temperature zone therein switchable between a freezing temperature zone and a temperature zone for refrigerated foods, vegetables or chilled foods, the refrigerator can be provided which can have a desired temperature zone arranged at a position with easy access and which is very convenient to be used.

When the refrigerator comprises a main body; a refrigerating compartment arranged at an upper position in the main body to refrigerate foods; a switchable compartment arranged under the refrigerating compartment in the main body to make a temperature zone therein switchable between a freezing temperature zone and a temperature zone for refrigerated foods, vegetables or chilled foods; a ice storing compartment arranged in parallel with the switchable compartment under the refrigerating compartment in the main body to store ice; a freezer compartment arranged at a lower position in the main body to freeze foods; and a vegetable compartment arranged between the switchable compartment and the ice storing compartment in parallel and the freezer compartment to store vegetables, the refrigerator can be provided which has all the compartments arranged at positions with easy access and which is very convenient to be used.

When the air return path for the refrigerating compartment is communicated with the vegetable compartment, the space in the refrigerator can be effectively utilized.

When the air supply path for the switchable compartment to supply the cooled air into the switchable compartment is provided, a required air volume into the switchable compartment can be ensured to stabilize temperature control.

When the air supply path for the switchable compartment, and the air supply path for the refrigerating compartment to divide part of the cooled air passing through the air supply path for the ice storing compartment are provided, the refrigerating compartment and the switchable compartment can carry out air volume control independently to supply a stable air volume.

When the air supply path for the switchable compartment, the air supply path for the ice storing compartment, and the air supply path for the refrigerating compartment are independently provided, each of the compartments can be supplied with an air volume without being affected by the temperature control in the other compartments, stabilizing the temperature control in each of the compartments.

When the twin damper for carrying out temperature control in the switchable compartment and the refrigerating compartment is provided, space in the refrigerant can be saved and the cost can be reduced.

When there is provided the second air return path for the refrigerating compartment which forwards part of the cooled air in the air return path for the refrigerating compartment directly to the air return path for the vegetable compartment, throttling of the cooled air returning from refrigerating compartment which is required to prevent the vegetable compartment form being overcooled can be eliminated to reduce the pressure loss in the return path, cooling the refrigerating compartment with a great deal of cooled air and improving cooling performance such as cooling speed.

When the refrigerator further comprises a first partition for dividing an inner space in the main body into an upper portion and a lower portion so as to arrange the refrigerating compartment in the upper portion, the first partition being mounted in an inner casing forming an inner side of the main body when the inner casing is shaped; a second partition arranged at a rear side in the lower portion partitioned by the first partition in the main body from a front side of the main body after a cooling section with a cooling device and an air circulating fan is mounted in the main body, the second partition separating the cooling section from the compartments and having a molded heat insulating material included therein; a third partition for dividing a portion in front of the second partition into an upper section and a lower section so as to provide the freezer compartment in the lower section; and a fourth partition having a reversed T-character cross-section for dividing a space between the first partition and the third partition into three sections so as to arrange the ice storing compartment and the switchable compartment in parallel under the first partition and arrange the vegetable compartment above the third partition, a compartment which has a higher temperature zone than the freezer compartment can be provided in front of the cooling section.

The mounting operation for the cooling device can be made easier because the partitions for the respective compartments are assembled in after mounting of the cooling device.

When the second partition has the air supply paths and the air return paths for the respective compartments provided therein, the number of required paths can be reduced, and the air paths can have the number of required engagement portions reduced and have a stable structure.

When the vegetable compartment and the switchable compartment are surrounded by the different partitions and both compartments have their own air supply path and air return path, the switchable compartment can be set to a refrigerating compartment, a freezer compartment, a vegetable compartment, a chilled food compartment or others, and the compartment with a desirable temperature zone can be set at a position with easy access.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

EMBODIMENT 1

Now, a first embodiment according to the present invention will be described in reference to the drawings.

Figure 1:
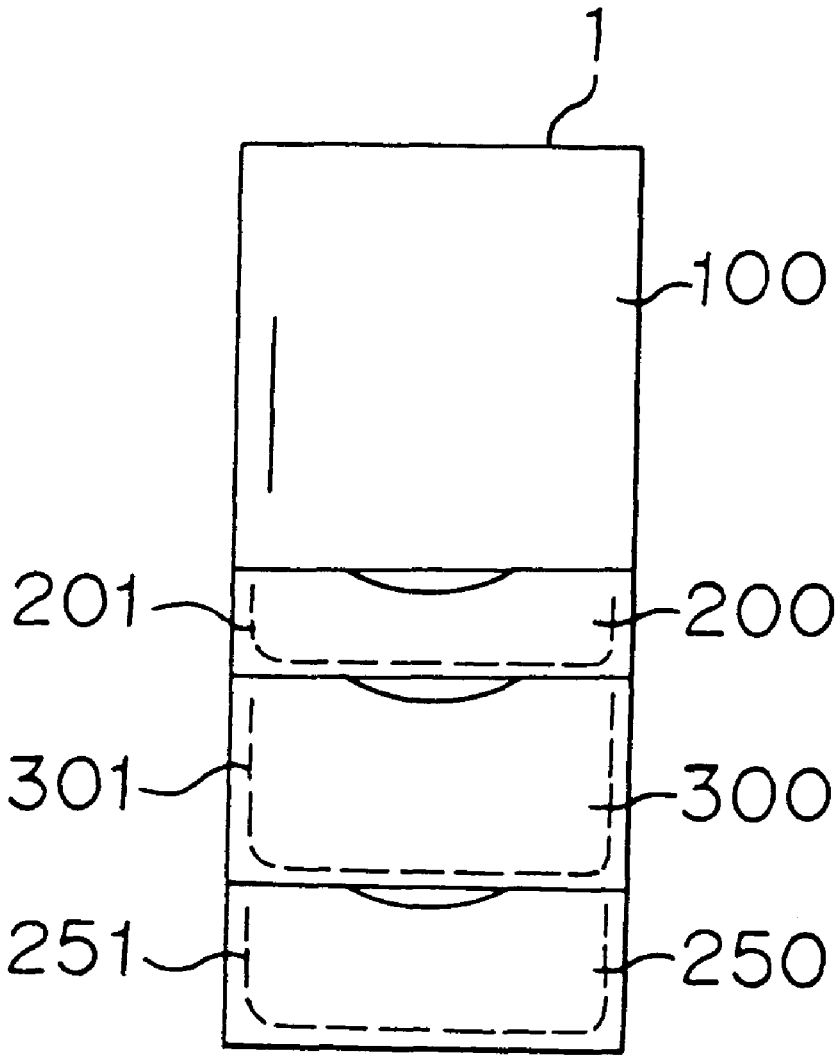
FIG. 1 is a front view of the refrigerator according to a first embodiment of the present invention.

In FIG. 1 is shown the refrigerator according to the first embodiment in a front view.

In this Figure, reference numeral 1 designates a main body of the refrigerator, and the main body 1 is constituted by a refrigerating compartment 100 with a door arranged at an upper position in the main body, a freezer compartment 200 with a drawer as a first freezer compartment arranged under the refrigerating compartment 100, a freezer compartment 250 with a drawer as a second freezer compartment arranged at the lowest position in the main body, and a vegetable compartment 300 with a drawer arranged between the freezer compartment 200 and the freezer compartment 250.

The freezer compartment 200 includes a storage casing 201 to store foods. The vegetable compartment 300 also includes a storage casing 301 to store foods such as vegetables. The freezer compartment 250 includes a storage casing 251 to storage foods.

For example, foods with a relatively greater frequency of use, e.g. frozen food for a packed lunch and ice cream, can be stored in the freezer compartment 200, and frozen food for long storage, e.g. food materials such as meat or fish for stock, can be stored in the freezer compartment 250, realizing separate storage.

The freezer compartment 200 has a smaller height than the freezer compartment 250 since the first freezer compartment is mainly directed to freezing or short storage. Because it is better to freeze sliced food in terms of quality, the decreased height of the upper freezer compartment in comparison with the lower freezer compartment 250 for stock does not create a problem. To the contrary, the freezer compartment 250 for stock has a higher height to ensure a required stock volume. The vegetable compartment is located at a central portion in height in the main body 1 to put things in and take them out without taking a crouching position and to provide such a great convenient to realize easy storage of big vegetables.

Figure 2:
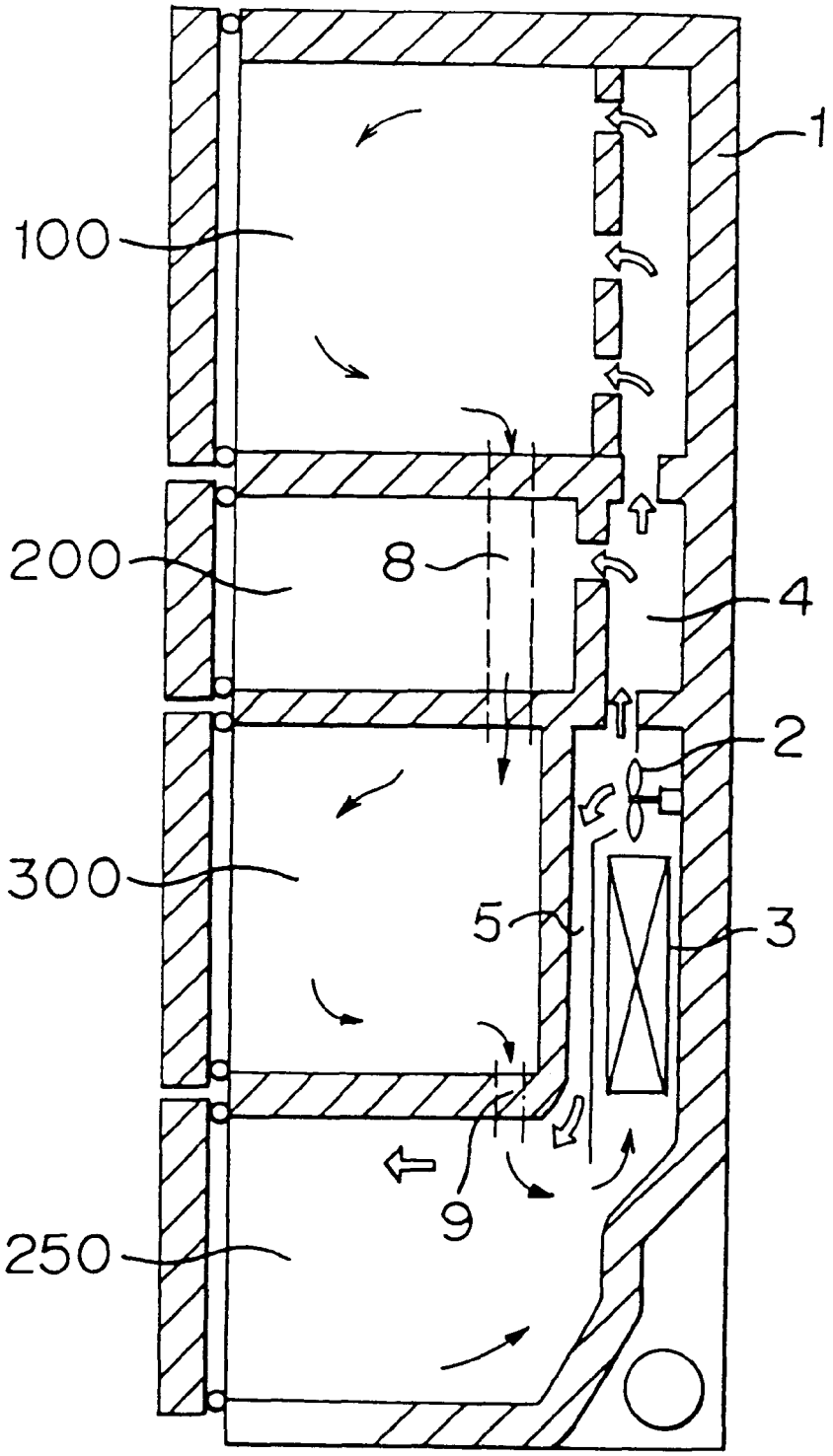
FIG. 2 is a sectional side view showing the structure of the air paths in the refrigerator according to the first embodiment.

In FIG. 2 is shown the structure of the air paths in the refrigerator according to the first embodiment as a sectional side view.

As shown, the air cooled by a cooling device 3 is circulated in the main body 1 of the refrigerator by a fan 2 as a fan device. The air cooled by the cooling device 3 is supplied into the lower freezer compartment 250 through an air supply path 5 for the lower freezer compartment 250. The air cooled by the cooling device 3 is also supplied to the upper freezer compartment 200 through an air supply path 4 for the upper freezer compartment 200. The cooled air which entered the air supply path 4 is partly supplied into the refrigerating compartment 100 at the upper position to cool the inside of the refrigerating compartment 100. The vegetable compartment 300 is cooled by introducing the cooled air from the refrigerating compartment 100 through an air return path 8 for the refrigerating compartment to circulate the cooled air in the vegetable compartment. Then, the cooled air is returned to a cooling section 3 through an air return path 9 for the vegetable compartment.

As stated earlier, in this embodiment with the freezer compartments separated at the upper position and the lower position, the air supply paths for the freezer compartments are separately arranged to extend in an upper direction and in a lower direction.

EMBODIMENT 2

Now, a second embodiment according to the present invention will be described in reference to the drawings.

Figure 3:
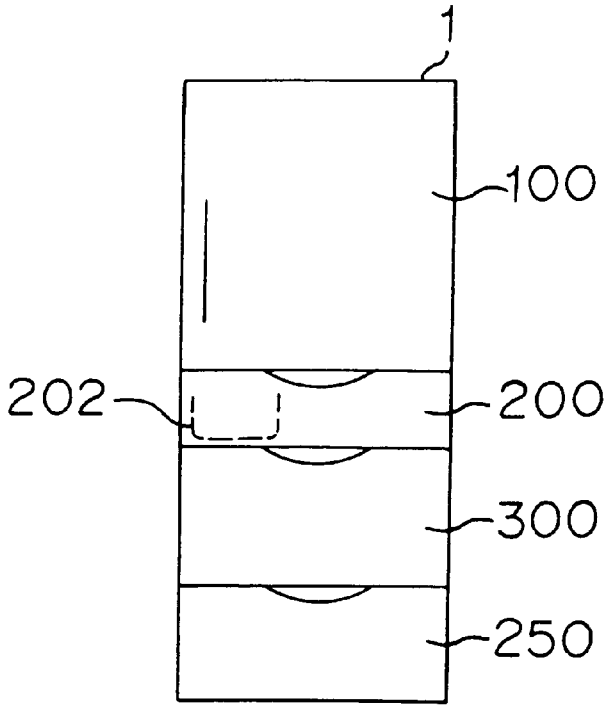
FIG. 3 is a front view of the refrigerator according to a second embodiment of the present invention.

In FIG. 3 is shown the refrigerator of the second embodiment as a front view.

In this Figure, reference numeral 202 designates an ice storing compartment which is arranged in the freezer compartment 200. The ice storing compartment 202 is a space wherein ice is produced with a commercially available ice tray or a vessel and the produced ice is stored. When an automatic ice maker is accommodated in the refrigerator, the ice storing compartment is used as a space to store ice produced by the automatic ice maker.

Although the ice stored in the ice storing compartment 202 is housed in the freezer compartment, the ice is utilized in a relatively frequent manner and without treatment prior to use. The provision of the ice storing compartment at the central portion in height in the main body 1 and above the vegetable compartment 300 provides a user with easy access. In addition, the provision of the ice storing compartment above the vegetable compartment 300 for storing vegetables easily covered by dirt or dust allows the user to use the ice storing compartment without worry in terms of hygiene.

EMBODIMENT 3

Now, a third embodiment according to the present invention will be described in reference to the drawings.

Figure 4:
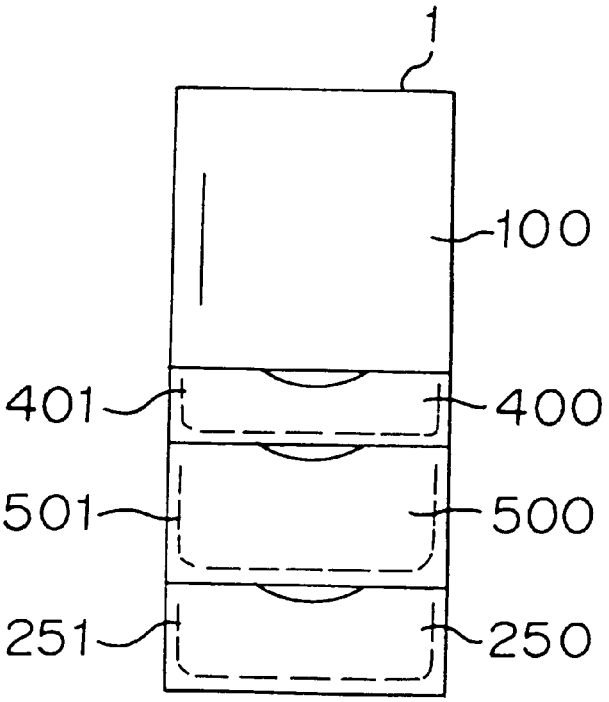
FIG. 4 is a front view of the refrigerator according to a third embodiment of the present invention.

In FIG. 4 is shown the refrigerator with a freezer of the third embodiment as a front view.

In this Figure, reference numeral 400 designates a switchable compartment as a first switchable compartment, which is arranged under a refrigerating compartment 100, is provided with a drawer, and can make a temperature zone therein switchable between a freezing temperature zone and a temperature zone for refrigerated foods, vegetable or chilled foods.

Reference numeral 500 designates another switchable compartment as a second switchable compartment, which is arranged at a central position in the main body 1 between the first switchable compartment 400 and a freezer compartment 250 at the lowest position, is provided with a drawer, and can make a temperature zone therein switchable between the freezing temperature zone and the temperature zone of not lower than 0° C. for refrigerated foods, vegetable or chilled foods. The first switchable compartment 400 can include a storage casing 401 to store variety of foods. The second switchable compartment 500 can also include a storage casing 501.

For example, if the first switchable compartment 400 is set to a chilled temperature zone (0° C.), and if the second switchable compartment 500 is used as a vegetable compartment, the chilled compartment for storing foods for a long period of time without freezing the same, and the vegetable compartment can occupy a position suited to easy access, realizing a refrigerator which is easily accessible and convenient to a person fond of uncooked foods.

If meat or fish is stored for about a week, storing it in the chilled compartment is more convenient because of no need for thawing in comparison with freezing, and provides a better taste. Since vegetables are frequently taken out (the vegetable compartment is more frequently opened and closed than the other compartments because cabbage or lettuce is taken out and stored again after having used part of it), the vegetable compartment is located at the central position. It is very convenient since stored articles required for daily cooking can be taken out of the chilled compartment, the vegetable compartment and the refrigerating compartment.

If the first switchable compartment 400 is switched to the freezing temperature zone (−18° C.) depending on seasons to store ice cream or ice in summer at an easily acceptable position, and if the second switchable compartment 500 is switched the chilled temperature zone to store a wide range of foods from vegetables to meat and fish, the refrigerator can have a layout therein formed so as to improve storage ability and provide easy access.

EMBODIMENT 4

Now, a fourth embodiment according to the present invention will be described with reference to the drawings.

Figure 5:
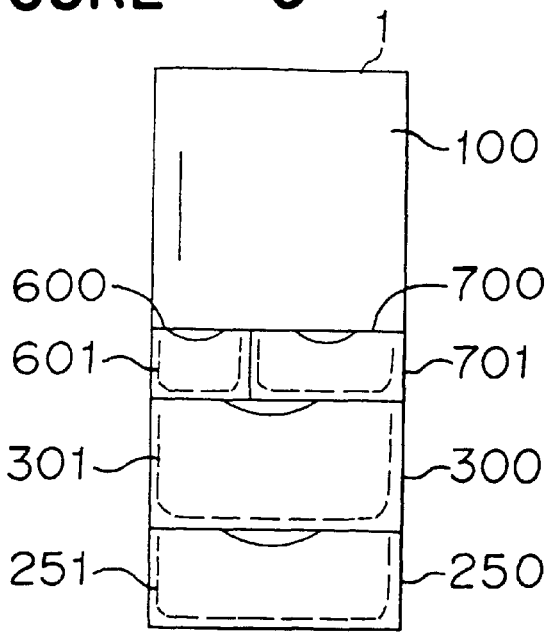
FIG. 5 is a front view of the refrigerator according to a fourth embodiment of the present invention.

In FIG. 5 is shown the refrigerator of the fourth embodiment as a front view.

In this Figure, reference numeral 600 designates an ice storing compartment which is arranged under a refrigerating compartment 100 and is provided with a drawer, and reference numeral 700 designates a switchable compartment which is arranged in parallel with the ice storing compartment 600, is provided with a drawer and can make a temperature zone therein switchable between the freezing temperature zone (−18° C.) and a temperature zone for refrigerated foods, vegetables or chilled foods.

The ice storing compartment 600 and the switchable compartment 700 include storing casings 601 and 701, respectively. The ice storing compartment 600 and the switchable compartment 700 are completely separated by a heat insulating wall at their top, side and rear surfaces.

A vegetable compartment 300 with a drawer is arranged under the ice storing compartment 600 and the switchable compartment 700, and a freezer compartment 250 with a drawer is arranged at the lowest position in the main body 1. The vegetable compartment 300 and the freezer compartment 250 are separated by a heat insulating wall because the both compartments have different temperature zones of 5° C. and −18° C.

For example, when the switchable compartment 700 is switched to the chilled temperature zone for use, the refrigerating compartment 100, the ice storing compartment 600, the chilled compartment 700 and the vegetable compartment 300 can occupy positions at a central portion in terms of height in the main body 1 to provide a refrigerator which is convenient to in particular a chilled food lover who is fond of storage without freezing.

In this case, uncooked foods such as meat and fish can be stored in the chilled compartment 700 for about a week, and ice, which is frequently used, can be, at any time, taken out of the ice storing compartment 600 which is independently arranged and provides easy access.

Since the vegetable compartment 300 is frequently opened and closed as stated with respect to the third embodiment, the vegetable compartment occupies a middle position easy to access. The refrigerating compartment 100 and the other compartments for meat, fish, vegetables and ice occupy positions easy to access at an eye level.

When the switchable compartment 700 is switched to a freezer compartment, frozen foods which are comparatively frequently used or are required to be used soon e.g. (frozen food for a packed lunch, ice cream or home-frozen foods that spoil quickly) can be stored in the switchable compartment 700, and food to be stored for a long period of time can be stored in the freezer compartment 250 at the lowest position, realizing separated storage. The freezer compartment 700, the ice storing compartment 600, the vegetable compartment 300 and the refrigerating compartment 100, consequently all temperature zones in the refrigerator can be arranged at positions with easy to access. In addition, the volume in the freezer compartment can be increased, providing a refrigerator which is very convenient to a user who is fond of frozen foods.

Figure 6:
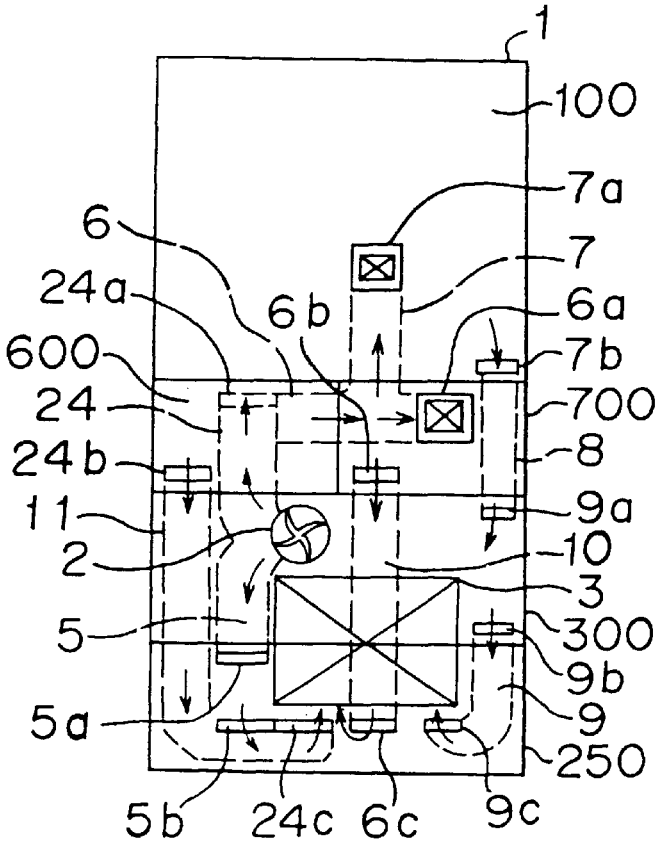
FIG. 6 is a schematic view showing the air paths in the refrigerator according to the fourth embodiment of the present invention.

In FIG. 6 is shown a sectional front view of the structure of the air paths in the refrigerator shown in FIG. 5. In this Figure, reference numeral 2 designates a fan, by which the cooled air cooled at a cooling device 3 is circulated in the main body 1. The cooled air cooled at the cooling device 3 passes in an air supply path 24 for the ice storing compartment and is supplied into the ice storing compartment 600 through an outlet 24*a*. The cooled air also passes in an air supply path 5 for the freezer compartment and is supplied into the freezer compartment 250 through an outlet 5*a*.

The switchable compartment 700 is cooled by supplying part of the cooled air in the air supply path 24 into an air supply path 6 for the switchable compartment and sending the part into the switchable compartment 700 controlled by a damper 6*a* for the switchable compartment.

The cooled air which passes through the air supply path 6 for the switchable compartment is partly supplied into an air supply path 7 for the refrigerating compartment, and the refrigerating compartment 100 is cooled by that part of the cooled air controlled by a damper 7*a* for the refrigerating compartment. An air return path 8 for the refrigerating compartment, which sucks the cooled air through an inlet 7*b* to return the cooled air from the refrigerating compartment 100, is provided to communicate with the vegetable compartment 300, cooling the inside of the vegetable compartment 300.

The cooled air is forwarded from the refrigerating compartment 100 into the vegetable compartment 300 through an outlet 9*a*, the air cooling the inside of the vegetable compartment 300, then entering an air return path 9 for the vegetable compartment through an inlet 9*b*, and returning to the cooling device 3 through a return port 9*c*.

The cooled air which has been blown out into the ice storing compartment 600 passes in an air return part 11 for the ice storing compartment through an inlet 24*b* and returns to the cooling device 3 through a return port 24*c*.

The cooled air in the freezer compartment 250 is also sucked through an inlet 5*b* and is returned to the cooling device section 3.

The cooled air which has cooled the inside of the switchable compartment 700 is sucked through an inlet 6*b*, is forwarded in an air return path 10 for the switchable compartment, and is returned to the cooling device 3 through a return port 6*c*.

The inside of the refrigerator can be effectively utilized by connecting the air return path 8 for the refrigerating compartment 100 to the vegetable compartment 300. If the refrigerating compartment and the vegetable compartment have independent air return paths, the volume for both air return paths is required to be provided in the refrigerator, thus making it difficult to enlarge a space for storing foods.

EMBODIMENT 5

Figure 7:
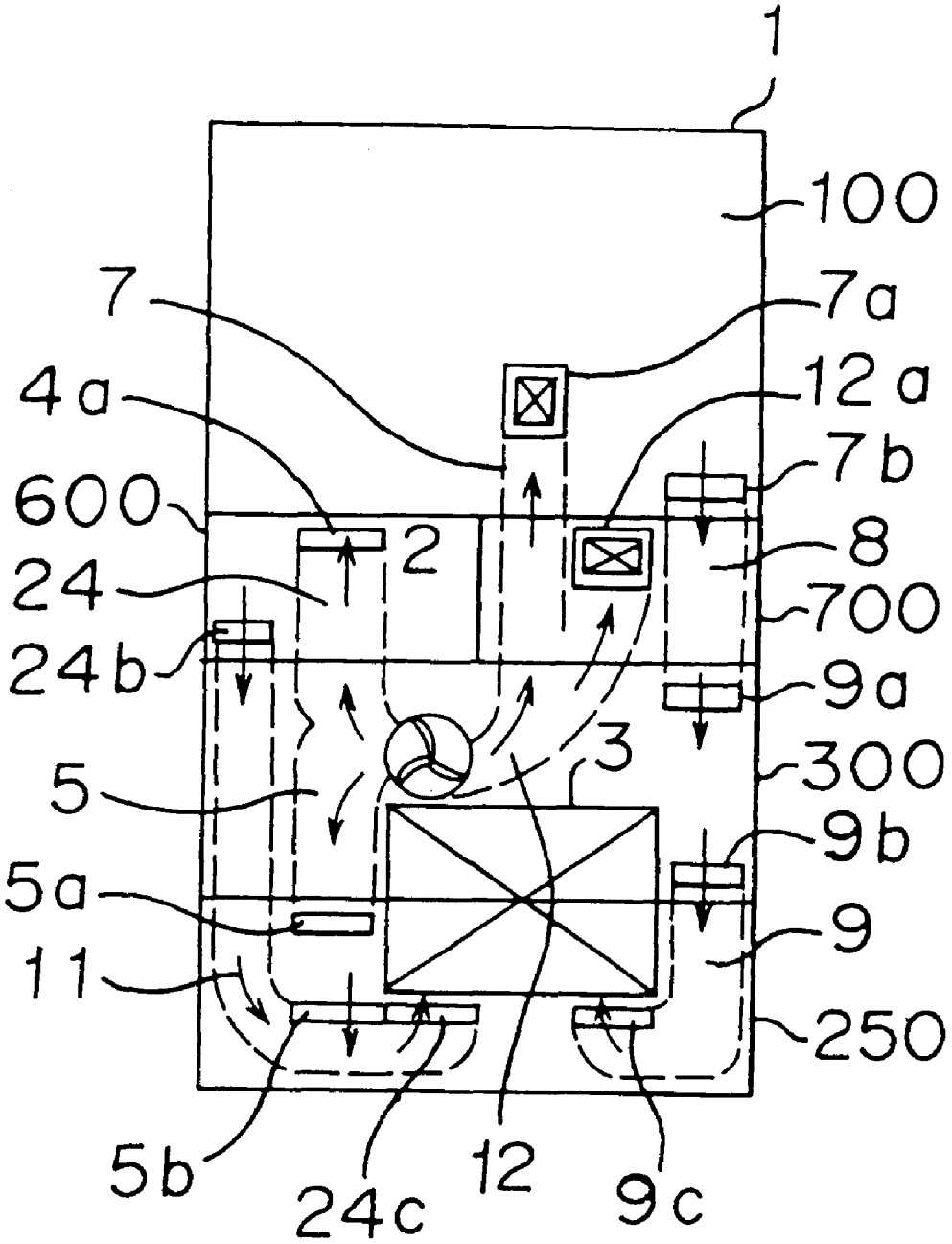
FIG. 7 is a schematic view showing the air paths in the refrigerator according to a fifth embodiment of the present invention.

In FIG. 7 is shown a schematic diagram of the air paths in the refrigerator according to a fifth embodiment.

Although, in the fourth embodiment, the cooled air which is forwarded by the air path 6 provided through the ice storing compartment 600 is supplied to the switchable compartment 700 under control by the damper 6*a* to cool the inside of the switchable compartment 700, an air path 12 for the switchable compartment 700 may be independently provided to forward the cooled air directly from the cooling device section 3 into the switchable compartment as shown in FIG. 7. Such arrangement can ensure a required air volume to the switchable compartment 700 to provide stable temperature control therein.

EMBODIMENT 6

Figure 8:
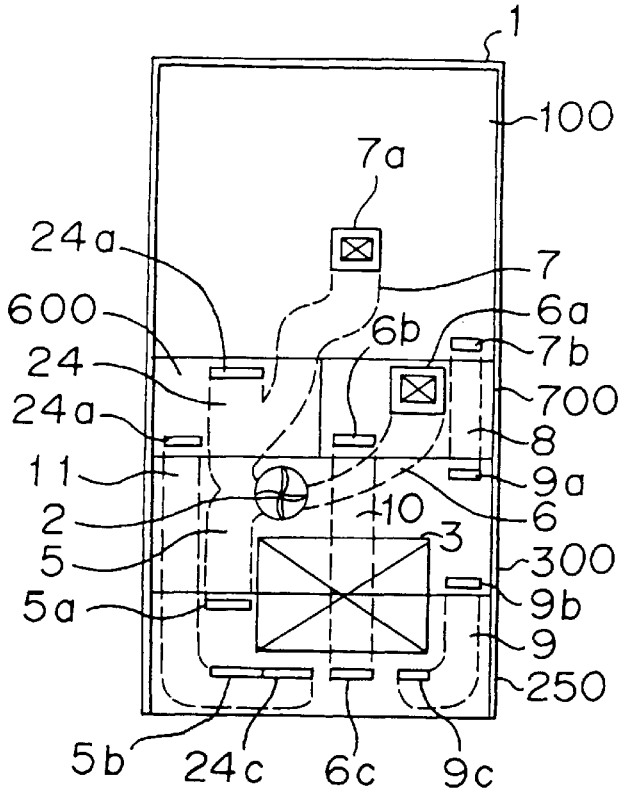
FIG. 8 is a schematic view showing the air paths in the refrigerator according to a sixth embodiment of the present invention.

In FIG. 8 is shown a schematic diagram of the air paths in the refrigerator according to a sixth embodiment.

An explanation thereof will be mainly made with respect to the differences between the fourth embodiment and the sixth embodiment. The sixth embodiment is different from the fourth embodiment in that the cooled air passing in the air supply path 24 for the ice storing compartment is partly supplied into the air supply path 7 for the refrigerating compartment. Such arrangement can provide the damper 7*a* for the refrigerating compartment and the damper 6*a* for the switchable compartment at different air supply paths to supply a stabilized air volume to the refrigerating compartment 100 without being affected by the damper 6*a* for the switchable compartment, carrying out stable temperature control in the refrigerating compartment 100.

Such arrangement can also supply a stable air volume to the switchable compartment 700 without being affected by the damper 7*a* for the refrigerating compartment, carrying out stable temperature control in the switchable compartment 700.

EMBODIMENT 7

Figure 9:
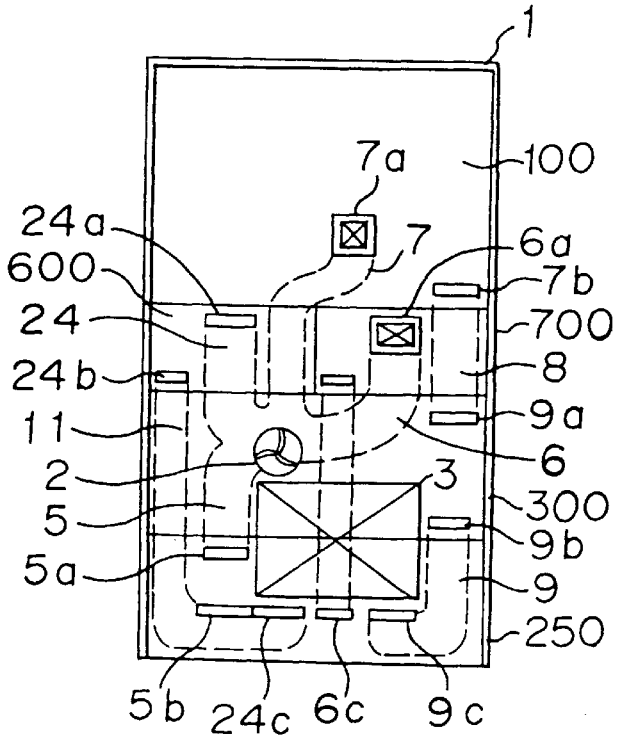
FIG. 9 is a schematic view showing the air paths in the refrigerator according to a seventh embodiment of the present invention.

In FIG. 9 is shown a schematic diagram of the air paths in the refrigerator according to a seventh embodiment.

The air path 24 for the ice storing compartment, the air path 6 for the switchable compartment and the air path 7 for the refrigerating compartment can be independently provided to supply a stable air volume to each of the compartments without being affected by the temperature control in the different compartments, carrying out stable temperature control in each of the compartments.

The absence of connected portions between the respective air paths can reduce the number of parts such as a cooled air leakage seal, and reduce the cost since the respective cooled air supply paths are independently provided without passing through different compartments.

EMBODIMENT 8

Figure 10:
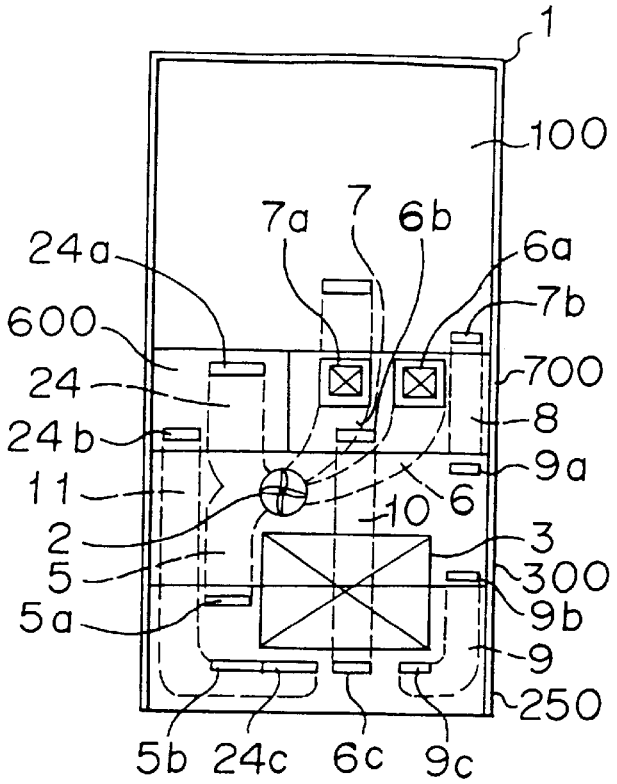
FIG. 10 is a schematic view showing the air paths in the refrigerator according to an eighth embodiment of the present invention.

In FIG. 10 is shown a schematic diagram of the air paths in the refrigerator according to an eighth embodiment.

The damper 6*a* for the switchable compartment and the damper 7*a* for the refrigerating compartment are combined into a twin damper provided at a rear wall of the switchable compartment 700, and the temperature control in the switchable compartment 700 and the refrigerating compartment 100 is carried out by the twin damper. Such arrangement can eliminate the provision of dampers at both the refrigerating compartment 100 and the switchable compartment 700, leading to space saving and a reduction in cost of the damper.

EMBODIMENT 9

Figure 11:
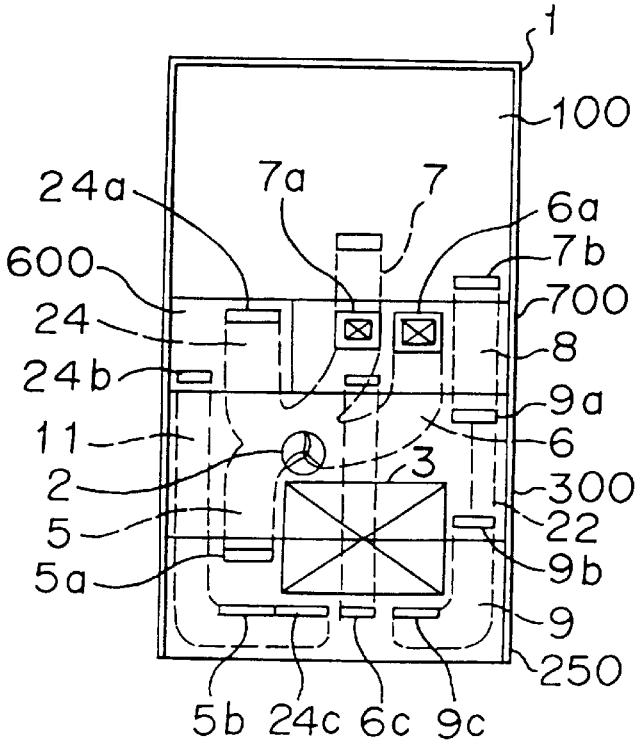
FIG. 11 is a schematic view showing the air paths in the refrigerator according to a ninth embodiment of the present invention.

In FIG. 11 is shown a schematic diagram of the air paths in the refrigerator according to a ninth embodiment.

The air return path 8 for the refrigerating compartment is arranged to communicate with the vegetable compartment 300 in order to forward the cooled air in the refrigerating compartment 100 from the inlet 7*b* into the vegetable compartment. The vegetable compartment 300 is cooled by part of the forwarded cooled air, and the remaining part of the cooled air is forwarded directly into the air return path 9 for the vegetable compartment through a second air return path 22 for the refrigerant compartment without being blown out into the vegetable compartment 300. Then, the remaining part of the cooled air is returned to the cooling device 3 through the return port 9*c*. Such arrangement can reduce the pressure loss in the return paths since the cooled air returning from the refrigerating compartment 100 is not required to be throttled to prevent the vegetable compartment 300 from being overcooled. As a result, the refrigerating compartment 100 can be cooled by a great deal of cooled air to improve cooling performance such as cooling speed.

EMBODIMENT 10

Now, a tenth embodiment according to the present invention will be described in reference to the drawings.

Figure 12:
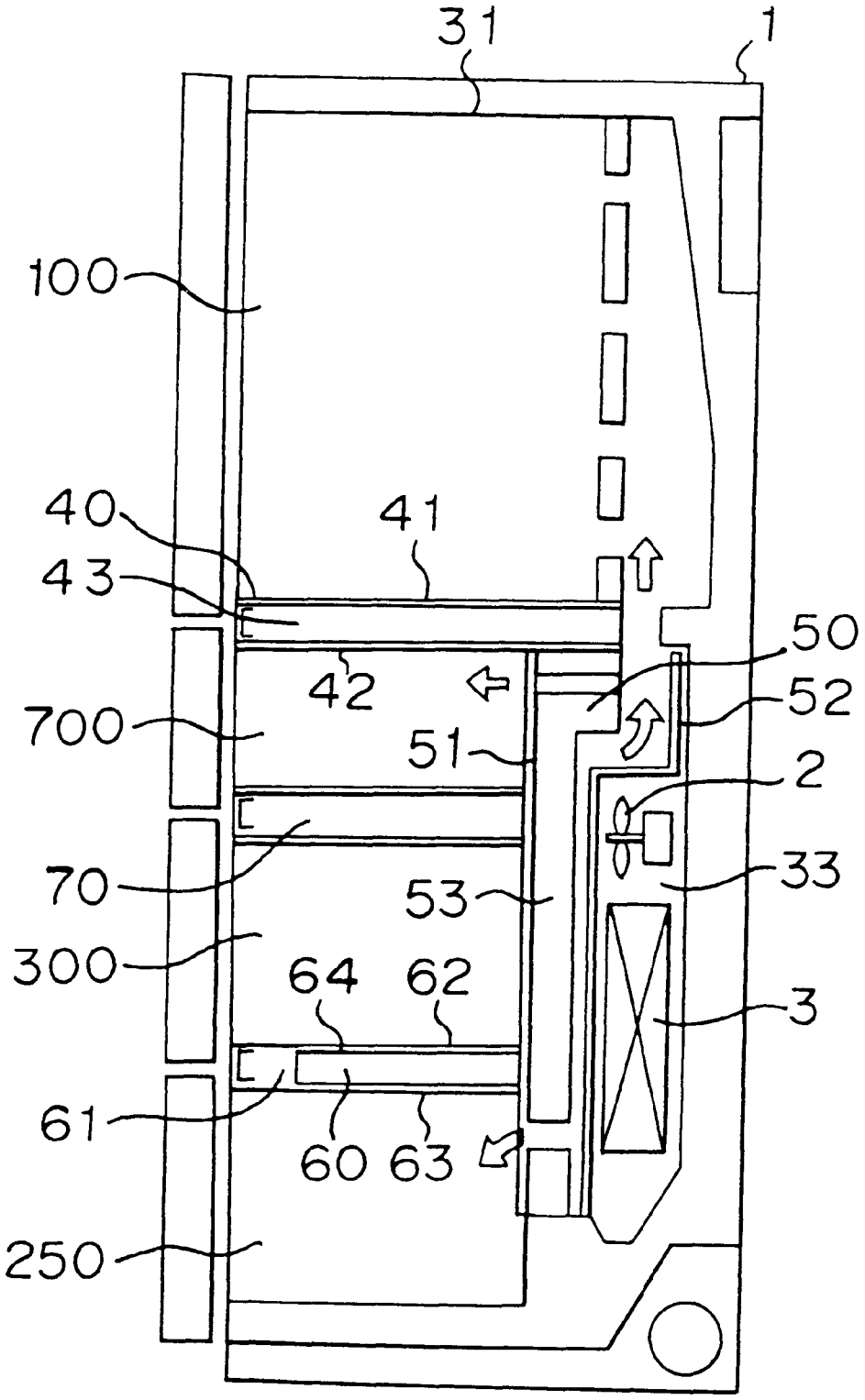
FIG. 12 is a sectional side view showing the structure of the air paths in the refrigerator according to a tenth embodiment of the present invention.
Figure 13:
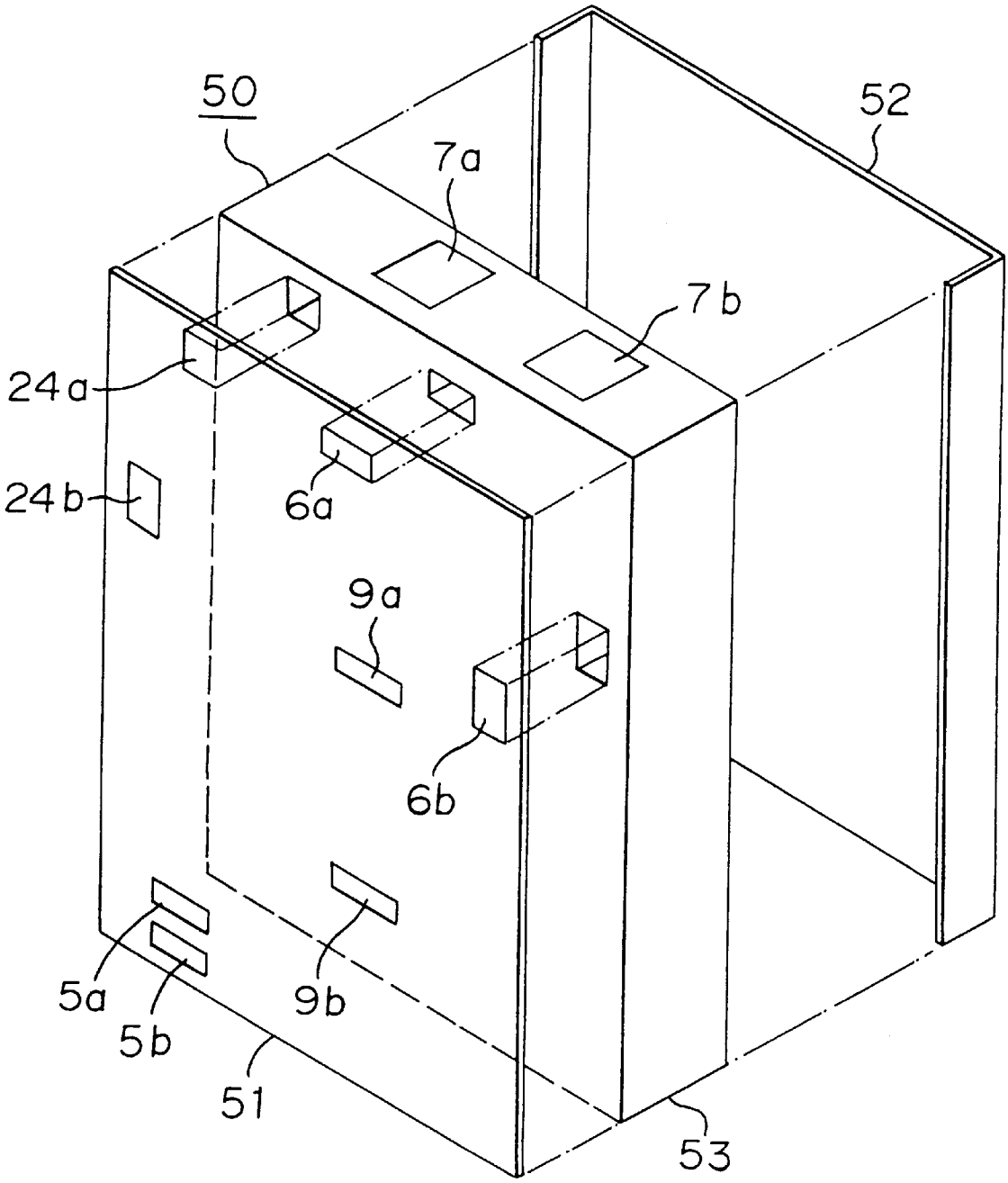
FIG. 13 is a perspective view showing the structure of the second partition in the refrigerator according to the tenth embodiment.
Figure 14:
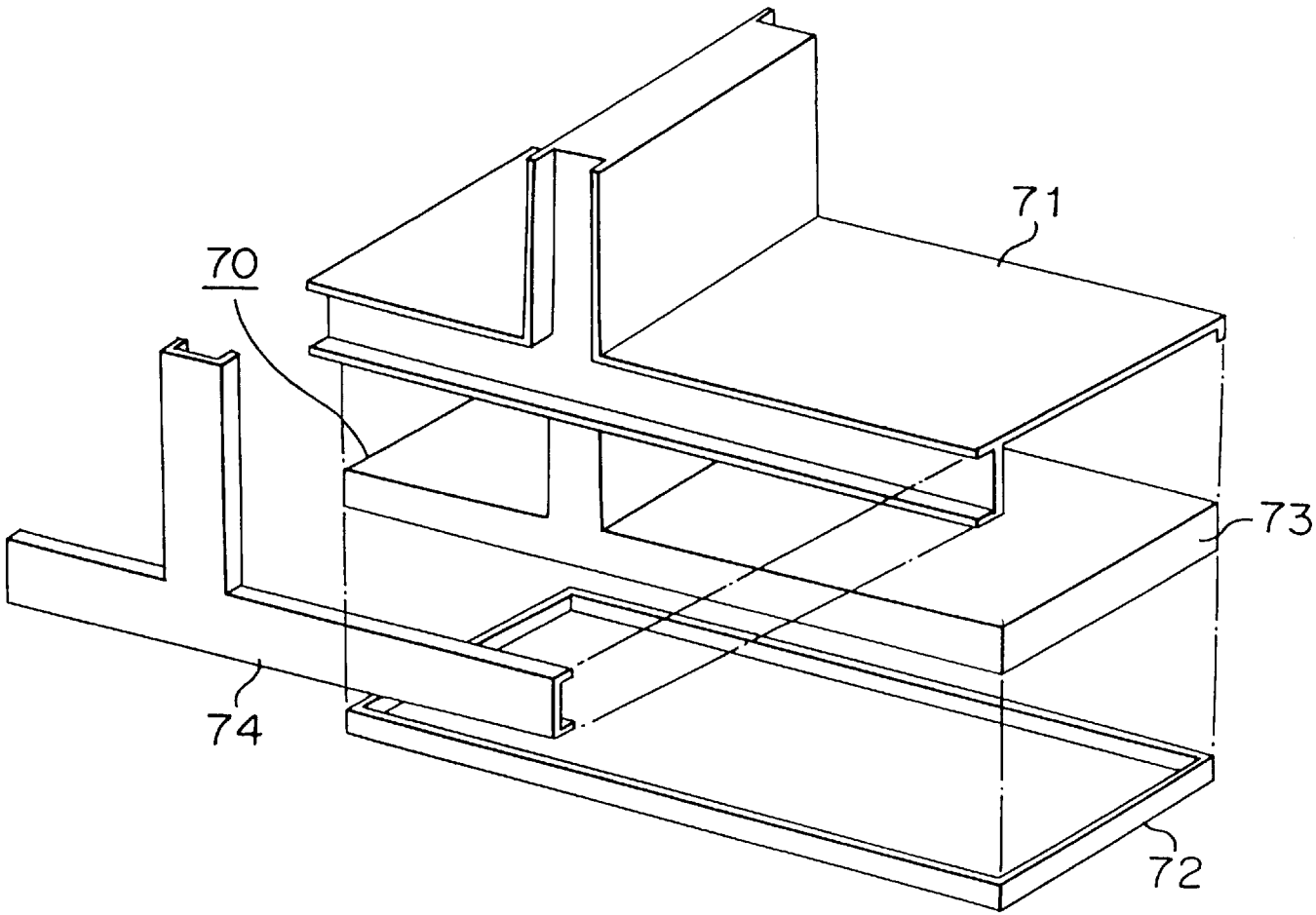
FIG. 14 is a perspective view showing the structure of the fourth partition in the refrigerator according to the tenth embodiment.
Figure 15:
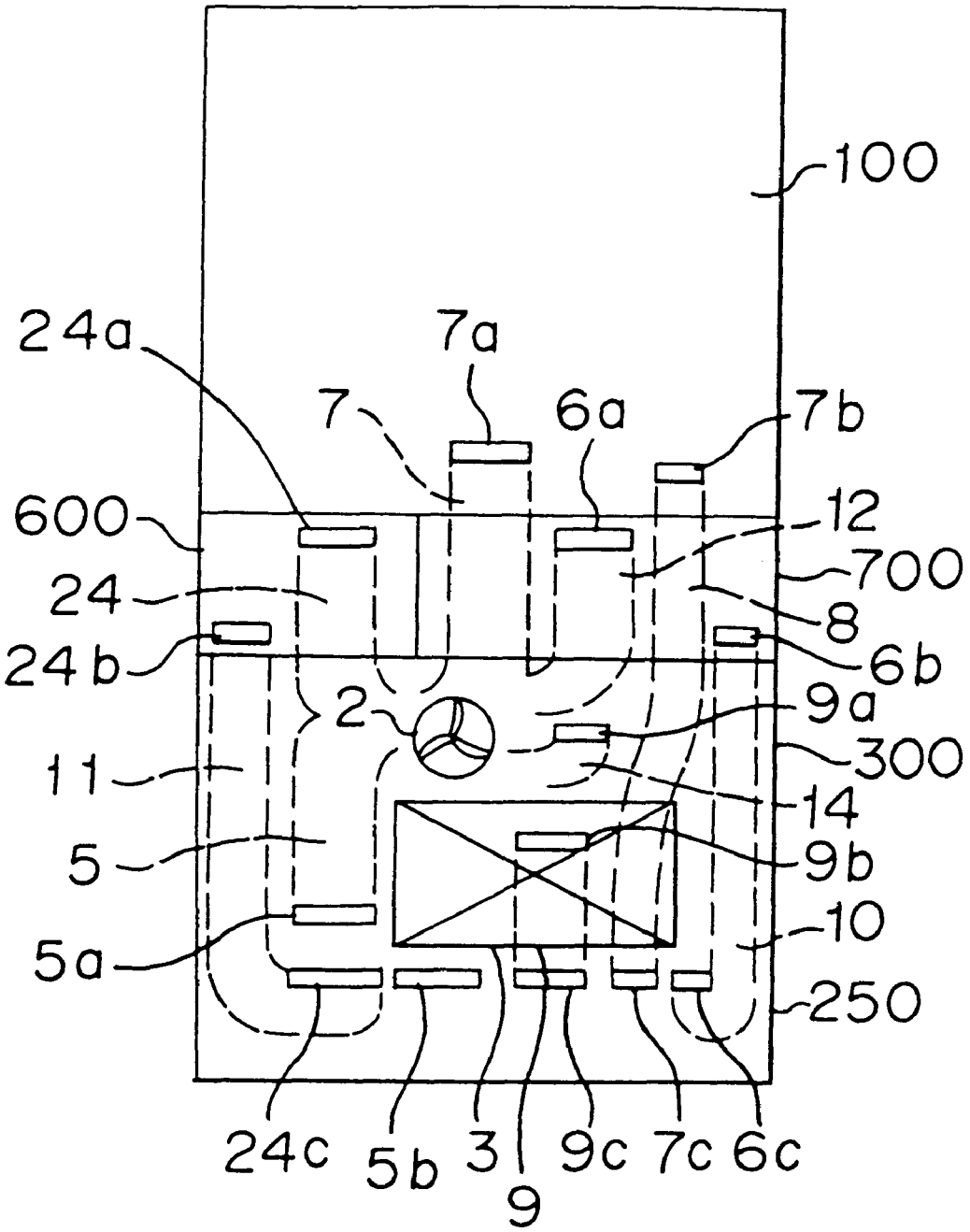
FIG. 15 is a schematic view showing the air paths in the refrigerator according to the tenth embodiment.
Figure 16:
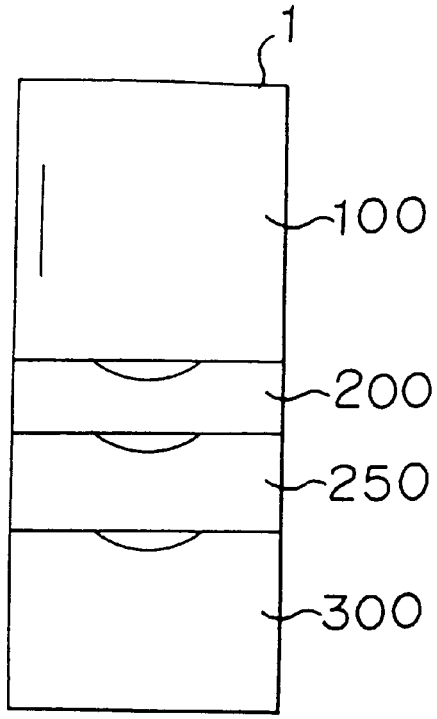
FIG. 16 is a front view of a conventional refrigerator.
Figure 17:
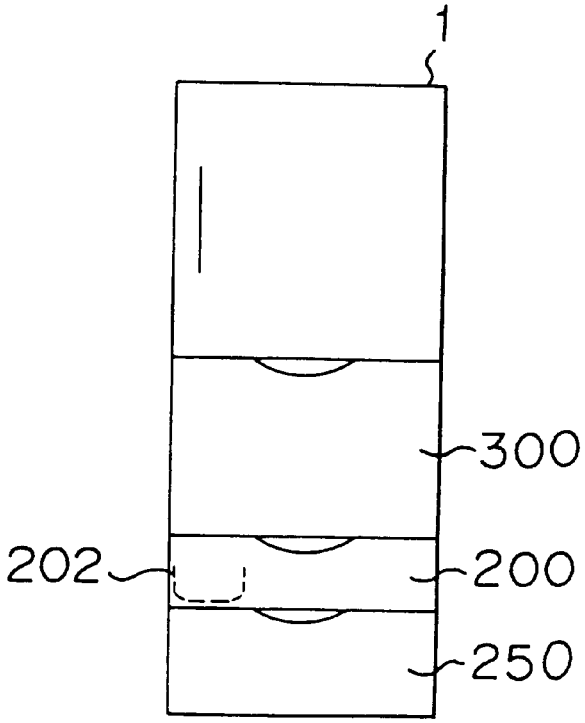
FIG. 17 is a front view of another conventional refrigerator.

In FIG. 12 is shown a sectional side view of the refrigerator according to the tenth embodiment. In FIG. 13 is shown a perspective view of the structure of a second partition. In FIG. 14 is shown a perspective view of the structure of a fourth partition. In FIG. 15 is shown a schematic diagram of the air paths in the refrigerator.

In these Figures, reference numeral 33 designates a cooling device space which is arranged at a lower and rear position in the refrigerator 1, and which houses the cooling device 3 and the fan 2 for circulating the air cooled by the cooling device 3.

Reference numeral 40 designates a first partition which divides the inside of the refrigerator 1 into an upper portion and a lower portion to separate the refrigerating compartment 100 from the other compartments. Reference numeral 41 designates an upper plate of the first partition, reference numeral 42 designates a lower plate of the first partition, and reference numeral 43 designates a molded heat insulating material in the first partition.

Reference numeral 50 designates a second partition which separates the cooling device space 33 from the respective compartments at the lower and rear portion in the refrigerator 1 separated by the first partition 40. Reference numeral 51 designates a fan grille which forms a front side of the second partition 50. Reference numeral 52 designates an air guide which forms a rear side of the second partition 50. Reference numeral 53 designates a molded heat insulating material which is provided between the fan grille 51 and the air side 52.

Reference numerals 24*a*, 6*a*, 5*a* and 9*a* designate an outlet for the ice storing compartment, an outlet for the switchable compartment, an outlet for the freezer compartment and an outlet for the vegetable compartment, respectively, which are provided in the fan grille.

Reference numerals 24*b*, 6*b*, 5*b* and 9*b* designate an inlet for the ice storing compartment, an inlet for the switchable compartment, an inlet for the freezer compartment and inlet for the vegetable compartment, respectively, which are provided in the fan grille.

Reference numerals 10 and 11 designate an air return path for the switchable compartment and an air return path for the ice storing compartment, respectively, which are constituted by the air guide. Reference numeral 7 designates an air supply path for the refrigerating compartment which is formed in the molded heat insulating material. Reference numeral 12 designates an air supply path for the switchable compartment which is formed in the molded heat insulating material. Reference numeral 8 designates an air return path for the refrigerating compartment, and reference numeral 9 designates an air return path for the vegetable compartment.

Reference numeral 60 designates a third partition which divides the lower and rear portion in the refrigerator 1 separated by the first partition into an upper portion and a lower portion to separate the freezer compartment 250 from the other compartments. Reference numeral 61 designates a front end partition which forms a front end portion of the refrigerator 1 to separate the freezer compartment 250 and the vegetable compartment 300. Reference numeral 62 designates an upper plate of the third partition, reference numeral 63 designates a lower plate of the third partition, and reference numeral 64 designates a molded heat insulating material in the third partition.

Reference numeral 70 designates a fourth partition which separates the ice storing compartment 600, the switchable compartment 700 and the vegetable compartment 300 and which is formed so as to have a reversed T-character cross-section. Reference numeral 71 designates an upper plate of the fourth partition, reference numeral 72 designates a lower plate of the fourth partition, reference numeral 73 designates a molded heat insulating material in the fourth partition, and reference numeral 74 designates a metallic plate which provides a receiving surface for door gaskets of the ice storing compartment 600, the switchable compartment 700 and the vegetable compartment 300.

Now, the mounting structure of each of the partitions will be explained.

The first partition 40 is formed with an inner casing 31 in a one-piece construction, and the first partition is mounted to the inner casing 31 so as to prevent the cooled air or water from leaking by bonding the molded heat insulating material 43 to the inner casing with heat generated on molding.

The second partition 50 is mounted to the inner casing 31 from a front side of the refrigerator to separate the cooling device section from the other compartments after having the cooling device 3 in a recessed portion formed in the inner casing. The second partition 50 has an outer periphery thereof formed with a sealing material to prevent the cool air on water from leaking.

The third partition 60 is mounted to the inner casing so as to cover a portion between the second partition 50 and the front end partition 61 which provides the receiving surface for the door gasket of each of the freezer compartment 100 and the vegetable compartment 300. The contacting surfaces of the first partition 40 and the second partition 50 with the inner casing 32 are sealed to prevent the cooled air or water from leaking between the freezer compartment 100 and the vegetable compartment 300.

The fourth partition 70 is mounted to the inner casing so that the fourth partition is slid from the front end of the refrigerator along a guide groove formed in the inner casing 32 after the second partition 50 is assembled into the refrigerator.

Now, the structure of the air paths will be described. The air cooled at the cooling device section 3 is supplied into an cooled air supply path defined by the air guide 52 and the molded heat insulating material 53 behind the second partition 50 by the fan 2. The cooled air is distributed to the air supply path 5 for the freezer compartment, the air supply path 24 for the ice storing compartment, the air supply 7 for the refrigerating compartment, the air supply path 12 for the switchable compartment and an air supply path 14 for the vegetable compartment from the cooled air supply path behind the second partition. These air supply paths are formed in the second partition.

The cooled air which has been supplied into the supply path 7 is regulated by a damper 7*a* for the refrigerating compartment, and is supplied into the refrigerating compartment 100 through an outlet for the refrigerating compartment. The cooled air which has circulated in the refrigerating compartment 100 enters the air return path 8 for the refrigerating compartment through an inlet 7*b* for the refrigerating compartment, and returns to the cooling device section 33 through a return port 7*c*.

The cooled air which has been forwarded into the air supply path 12 for the switchable compartment is regulated by a damper 6*a* for the switchable compartment and is supplied into the switchable compartment 700 through the outlet for the switchable compartment. The cooled air which has circulated in the switchable compartment 700 enters the air return path 10 for the switchable compartment through the inlet 6*b* for the switchable compartment and returns to the cooling device section 33 through a return port 6*c*.

The cooled air which has been forwarded into the air supply path 24 for the ice storing compartment is supplied into the ice storing compartment 600 through the outlet 24*a* for the ice storing compartment. The cooled air which has circulated in the ice storing compartment 600 enters the air return path 11 for the ice storing compartment through the inlet 24*b* for the ice storing compartment and returns to the cooling device compartment 33 through a return port 24*c*.

The cooled air which has been forward into the air supply path 5 for the freezer compartment is supplied into the freezer compartment 250 through the outlet 5*a* for the freezer compartment. The cooled air which has circulated in the freezer compartment 250 returns to the cooling device compartment 33 from the inlet 5*b* for the refrigerating compartment.

The cooled air which has been forwarded into the air supply path 14 for the vegetable compartment is supplied into the vegetable compartment 300 through the outlet 9*a*. The cooled air which has circulated in the vegetable compartment 300 enters the air return path 9 for the vegetable compartment through the inlet 9*b* for the vegetable compartments and returns to the cooling device section 33 through a return port 9*c*.

These return paths are formed in the second partition.

In accordance with this embodiment, the switchable compartment and the vegetable compartment are separated from the neighboring compartments by the heat insulating partition walls, and the switchable compartment and the vegetable compartment are provided with the exclusive air supply paths and the exclusive air return paths, respectively, allowing the switchable compartment to be set to any type of compartment such as a refrigerating compartment, a freezer compartment, a vegetable compartment and a chilled compartment.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigerator comprising:

a main body;

a refrigerating compartment arranged at an upper position in the main body to refrigerate foods; and at least three lower compartments vertically arranged under the refrigerating compartment;

wherein at least one of the lower compartments comprises a freezer compartment for freezing foods, and one of the remaining lower compartments comprises one of a vegetable compartment to store vegetables and a switchable compartment to make a temperature zone therein switchable between a freezing temperature zone and a temperature zone for refrigerated foods, vegetables or chilled foods.

2. The refrigerator according to claim 1, wherein the remaining lower compartments include a vegetable compartment to store vegetables and a second freezer compartment to freeze foods, and the vegetable compartment is arranged between the first freezer compartment and the second freezer compartment.

3. The refrigerator according to claim 2, wherein the first freezing compartment includes an ice storing compartment to store ice.

4. The refrigerator according to claim 1, wherein the remaining lower compartments include first and second switchable compartments to make a temperature zone therein switchable between a freezing temperature zone and a temperature zone for refrigerated foods, vegetables or chilled foods, and the second switchable compartment is arranged between the first switchable compartment and said freezer compartment.

5. The refrigerator according to claim 1, wherein the remaining lower compartments include a vegetable compartment to store vegetables and a switchable compartment to make a temperature zone therein switchable between a freezing temperature zone and a temperature zone for refrigerated foods, vegetables or chilled foods, wherein an ice storing compartment is arranged in parallel with the switchable compartment to store ice; and the vegetable compartment is arranged between the switchable compartment and the ice storing compartment and said freezer compartment to store vegetables.

6. The refrigerator according to claim 5, further comprising:

a cooling section including a cooling device for producing cooled air and a fan for supplying the cooled air into the respective compartments, and communicating with the freezer compartment;

an air supply path for said freezer compartment to supply the cooled air into said freezer compartment;

an air supply path for the ice storing compartment to supply the cooled air into the ice storing compartment;

an air return path for the ice storing compartment to return the cooled air from the ice storing compartment into the cooling section;

an air supply path for the switchable compartment to divide part of the cooled air passing through the air supply path for the ice storing compartment and supply the part into the switchable compartment;

an air return path for the switchable compartment to return the cooled air from the switchable compartment into the cooling section;

an air supply path for the refrigerating compartment to divide part of the cooled air passing through the air supply path for the switchable compartment and supply the part into said refrigerating compartment;

an air return path for said refrigerating compartment to forward the cooled air from said freezer compartment into the vegetable compartment; and an air return path for the vegetable compartment to return the cooled air from the vegetable compartment to the cooling device.

7. The refrigerator according to claim 6, further comprising a second air return path for the refrigerating compartment, which forwards part of the cooled air in the air return path for the refrigerating compartment directly to the air return path for the vegetable compartment.

8. The refrigerator according to claim 5, further comprising:

a cooling section including a cooling device for producing cooled air and a fan for supplying the cooled air into the respective compartments, and communicating with said freezer compartment;

an air supply path for said freezer compartment to supply the cooled air into said freezer compartment;

an air supply path for the ice storing compartment to supply the cooled air into the ice storing compartment;

an air return path for the ice storing compartment to return the cooled air from the ice storing compartment into the cooling section;

an air supply path for the switchable compartment to supply the cooled air into the switchable compartment;

an air return path for the switchable compartment to return the cooled air from the switchable compartment into the cooling section;

an air supply path for the refrigerating compartment to divide part of the cooled air passing through the air supply path for the switchable compartment and supply the part into the refrigerating compartment;

an air return path for the refrigerating compartment to forward the cooled air from the refrigerating compartment into the vegetable compartment; and an air return path for the vegetable compartment to return the cooled air from the vegetable compartment to the cooling device.

9. The refrigerator according to claim 8, further comprising a second air return path for the refrigerating compartment, which forwards part of the cooled air in the air return path for the refrigerating compartment directly to the air return path for the vegetable compartment.

10. The refrigerator according to claim 5, further comprising:

a cooling section including a cooling device for producing cooled air and a fan for supplying the cooled air into the respective compartments, and communicating with said freezer compartment;

an air supply path for the freezer compartment to supply the cooled air into said freezer compartment;

an air supply path for the ice storing compartment to supply the cooled air into the ice storing compartment;

an air return path for the ice storing compartment to return the cooled air from the ice storing compartment into the cooling section;

an air supply path for the switchable compartment to supply the cooled air into the switchable compartment;

an air return path for the switchable compartment to return the cooled air from the switchable compartment into the cooling section;

an air supply path for the refrigerating compartment to divide part of the cooled air passing through the air supply path for the ice storing compartment and supply the part into the refrigerating compartment;

an air return path for the refrigerating compartment to forward the cooled air from the refrigerating compartment into the vegetable compartment; and an air return path for the vegetable compartment to return the cooled air from the vegetable compartment to the cooling device.

11. The refrigerator according to claim 10, further comprising a second air return path for the refrigerating compartment, which forwards part of the cooled air in the air return path for the refrigerating compartment directly to the air return path for the vegetable compartment.

12. The refrigerator according to claim 5, further comprising:

a cooling section including a cooling device for producing cooled air and a fan for supplying the cooled air into the respective compartments, and communicating with said freezer compartment;

an air supply path for said freezer compartment to supply the cooled air into said freezer compartment;

an air supply path for the ice storing compartment to supply the cooled air into the ice storing compartment;

an air return path for the ice storing compartment to return the cooled air from the ice storing compartment into the cooling section;

an air supply path for the switchable compartment to supply the cooled air into the switchable compartment;

an air return path for the switchable compartment to return the cooled air from the switchable compartment into the cooling section;

an air supply path for the refrigerating compartment to supply the cooled air into the refrigerating compartment;

an air return path for the refrigerating compartment to forward the cooled air from the refrigerating compartment into the vegetable compartment; and an air return path for the vegetable compartment to return the cooled air from the vegetable compartment to the cooling device.

13. The refrigerator according to claim 12, wherein the switchable compartment has a rear wall provided with a twin damper for carrying out temperature control in the switchable compartment and the refrigerating compartment.

14. The refrigerator according to claim 12, further comprising a second air return path for the refrigerating compartment, which forwards part of the cooled air in the air return path for the refrigerating compartment directly to the air return path for the vegetable compartment.

15. The refrigerator according to claim 5, further comprising:

a first partition for dividing an inner space in the main body into an upper portion and a lower portion so as to arrange the refrigerating compartment in the upper portion, the first partition being mounted in an inner casing forming an inner side of the main body when the inner casing is shaped;

a second partition arranged at a rear side in the lower portion partitioned by the first partition in the main body from a front side of the main body after a cooling section with a cooling device and an air circulating fan is mounted in the main body, the second partition separating the cooling section from the compartments and having a molded heat insulating material included therein;

a third partition for dividing a portion in front of the second partition into an upper section and a lower section so as to provide the second freezer compartment; and a fourth partition having an inverted T-shaped cross-section for dividing a space between the first partition and the third partition into three sections so as to arrange the ice storing compartment and the switchable compartment in parallel under the first partition and arrange the vegetable compartment above the third partition.

16. The refrigerator according to claim 15, wherein the second partition has air supply paths for supplying the cooled air from the cooling section into the respective compartments and air return paths for returning the cooled air from the respective compartments into the cooling section provided therein.

17. The refrigerator according to claim 5, further comprising:

a cooling section including a cooling device for producing cooled air and a fan for supplying the cooled air into the respective compartments, and communicating with the freezer compartment;

an air supply path for the freezer compartment to supply the cooled air into the freezer compartment;

an air supply path for the ice storing compartment to supply the cooled air into the ice storing compartment;

an air return path for the ice storing compartment to return the cooled air from the ice storing compartment into the cooling section;

an air supply path for the switchable storing compartment to supply the cooled air into the switchable compartment;

an air return path for the switchable compartment to return the cooled air from the switchable compartment into the cooling section;

an air supply path for the refrigerating compartment to supply the cooled air into the refrigerating compartment;

an air return path for the refrigerating compartment to forward the cooled air from the refrigerating compartment into the cooling section;

an air supply path for the vegetable compartment to supply the cooled air into the vegetable compartment; and an air return path for returning the cooled air from the vegetable compartment to the cooling device.

* * * * *